United States Patent [19]

Griffin

[11] Patent Number: 4,819,140

[45] Date of Patent: Apr. 4, 1989

[54] COMPRESSIBLE FLASHLIGHT

[76] Inventor: James P. Griffin, 1216 Ash St., St. Charles, Ill. 60174

[21] Appl. No.: 240,008

[22] Filed: Sep. 2, 1988

[51] Int. Cl.[4] ..... F21L 7/00

[52] U.S. Cl. ..... 362/189; 362/205; 200/60

[58] Field of Search ..... 200/60; 362/189, 202, 362/205

[56] References Cited

U.S. PATENT DOCUMENTS

| | | | |
|---|---|---|---|
| 3,796,869 | 3/1974 | Stone | 362/189 X |
| 4,122,510 | 10/1978 | Halliday, Jr. | 362/189 |
| 4,242,724 | 12/1980 | Stone | 362/189 X |
| 4,429,352 | 1/1984 | Griffin | 362/109 |
| 4,524,409 | 6/1985 | Yakubek | 362/189 |
| 4,528,621 | 7/1985 | Hoyt | 362/189 |
| 4,644,451 | 2/1987 | Chabria | 362/189 |

*Primary Examiner*—Ira S. Lazarus
*Assistant Examiner*—Peggy Neils
*Attorney, Agent, or Firm*—John L. Schmitt

[57] ABSTRACT

A disposable-type flashlight comprises a hollow, flexible case having cap enclosed ends. Within the rear cap is a conductive pressure plate having a flat W-like configuration. Inner apexes of the pressure plate engage a positively charged end of an insulated battery and a negatively charged end of an uninsulated battery. The batteries are spaced apart within the case by a center post having a front end opening to hold an inner end of a bulb. One of two filament lead wires from the bulb is soldered to a negatively charged end of the insulated battery. The other lead wire is folded forward to fit in an opening in a middle web section a conductive, U-shaped spring switch. Spaced apart arms of this switch are positioned on each side of the batteries and fit firmly against an inner side of the case. An outer lens end of the bulb projects through the switch web section opening and an aperture in the front cap. This placement maintains the bulb lead wire in contact with the switch. To energize the flashlight finger pressure may be applied to the case to compress the switch arms. When one arm contacts the uninsulated battery, this contact completes an electrical circuit between the bulb and batteries to energize the bulb.

7 Claims, 1 Drawing Sheet

COMPRESSIBLE FLASHLIGHT

BACKGROUND OF THE INVENTION

1. Field of the Invention

This invention relates to flashlights generally and more particularly to high-reliability, reasonably cost, compact, disposable-type flashlights that may be energized by applying a compressive force to a case of the flashlight.

2. Prior Art

Compact, disposable-type flashlights have been available for some time, are well known and in wide use today.

One early disposable-type flashlight is set forth in U.S. Pat. No. 3,796,869. Manual compression of a flexible case of this instrument presses an end of a switch wire against an uninsulated sidewall of a battery to complete an electrical circuit with a bulb of this flashlight.

A further disposable-type flashlight is disclosed in U.S. Pat. No. 4,122,510. This flashlight includes a retainer to hold a pair of oppositely positioned batteries. A positive terminal of one of the batteries fits into an opening in one leg of an L-shaped switch member. Another leg of the switch may be pressed against an uninsulated wall of the other battery to complete an electrical circuit between the bulb and batteries.

A more recent disposable-type flashlight is disclosed in U.S. Pat. No. 4,429,352 issued to the inventor of the therein disclosed instrument. In this last flashlight one lead wire from a bulb of the flashlight is formed into a switch. Compression of a case of the flashlight engages this lead wire with a strap fitted about batteries of the flashlight to complete an electrical circuit and energize the bulb.

SUMMARY OF THE INVENTION

A disposable-type flashlight of this invention comprises a hollow, oval-shaped case made of flexible material. A front and rear cap cover respective ends of this case. Each cap has an aperture.

Within the flashlight case is a U-shaped spring switch made of a flat flexible, conductive material. The switch is defined by a central web section joined to spaced apart arms. The switch arms are sprung inward to fit in the case. As flexed, side edges of the arms press firmly against an inner side of the case. Additionally, corners of the switch central web section are in contact with the case to locate and maintain the position of the switch.

An outer lens end of a bulb extends through an opening in the switch central web section and the front cap aperture. An inner pointed end of the bulb then fits in an opening in a front end of a center post. The center post is positioned between a pair of batteries to hold such snuggly inside the case between and spaced from the switch arms. A first battery of the pair has an insulated outer casing. The second battery, positioned in an opposing manner, has an uninsulated outer casing.

A first filament lead wire of a pair extending from the bulb is soldered to a negatively charged end of the first battery. The second bulb lead wire in turn is folded forward to extend through the switch central web section opening and next to the bulb.

In the aperture of the rear cap is a key ring holder. Then, within this cap is a self-locating, flat W-like shaped pressure plate made of a flexible, conductive material. Inner apexes of the pressure plate align with and engage respective, oppositely charged ends of the batteries. Outer ends and an outer apex of the pressure plate in turn fit against an inner side of the rear cap and key ring holder. When the caps are affixed to the case, the pressure plate is flexed a slight amount. This flexing of the pressure plate creates a force to place the various components in the case under stress.

To operate this flashlight the flexible case is compressed. This compression forces at least one of the arms of the switch against the outer casing of the uninsulated battery and completes an electrical circuit between the bulb filament and the batteries.

This inventive disposable-type flashlight provides a combination of advantages over like flashlights known or in use.

A first advantage is that this flashlight is highly reliable. For a flashlight to be highly reliable, it should operate when it leaves the manufacturer, should work when purchased, and then should work each time and only when a user compresses the flashlight case until the batteries are exhausted. Note that any inadvertent energizing of the bulb reduces reliability because a useful life to the flashlight is shortened.

Reliability of this flashlight, as defined above, is increased significantly by the continuous force produced by the flexed pressure plate. The resulting stress enhances the conductive interaction between the pressure plate and the battery terminal ends and between the bulb lead wire and the switch central web opening. Note that this conductive interaction is produced merely by contact and not by a joining agent such as solder.

Reliability is further enhanced by the switch. Note first that the switch arms, once in the case, flex outward to minimize inadvertent contact with the uninsulated outer casing of the one battery. Additionally, the switch arms produce a dual-action effect so that only general and not selective compression of the case is required to energize the bulb. Only one arm need engage the battery casing to close the circuit including the bulb.

A second important advantage is that this highly reliable flashlight may be made at a reasonable cost. In this case cost of the flashlight first is controlled by using components that are high quality machine made. Secondly, these components then may be readily assembled by hand. Note that there are only three fixed connections, i.e. one bulb lead wire-battery end solder joint and two mastic joints between the case and end caps. All three are easy to make.

Assembly then is further enhanced by the self-locating configuration of the components. The spring switch self-locates in the case, the pressure plate self-locates in the rear cap, and the batteries and center post then self-locate in the case. Thus, these flashlights may be readily and reliably assembled into operative instruments. The cost of reworking inoperative flashlights is kept to a minimum.

DESCRIPTION OF THE PREFERRED EMBODIMENT

Figures 1, 2, 3, 4:
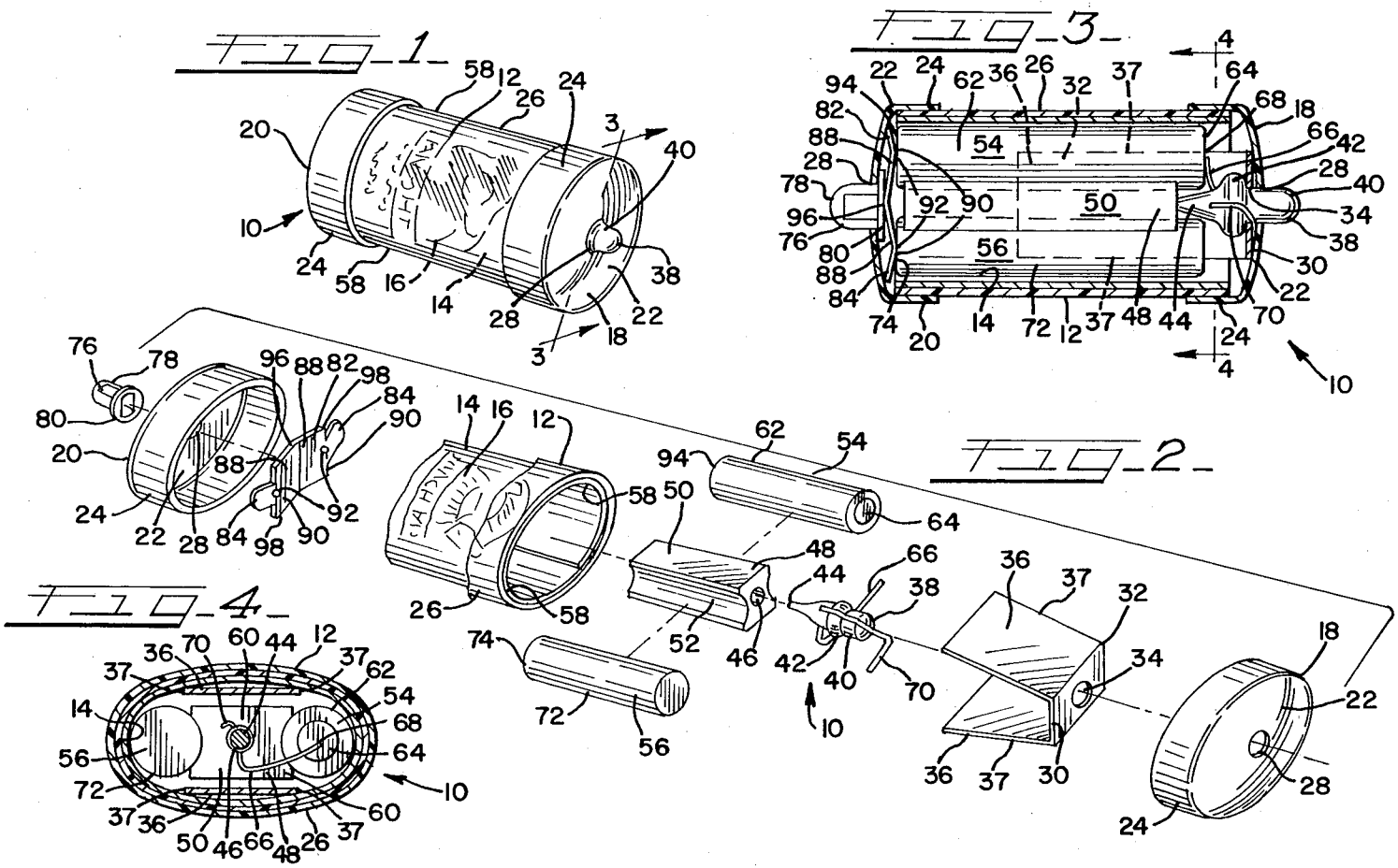
FIG. 1 is a perspective view of a disposable-type flashlight of this invention.
FIG. 2. is an exploded view in perspective of the flashlight of FIG. 1 showing the relations of the various flashlight components.
FIG. 3 is a cross sectional view as seen generally along the line 3—3 of FIG. 1.
FIG. 4 is a further cross sectional view as seen generally along the line 4—4 of FIG. 3.

A disposable-type flashlight of this invention is shown generally in FIGS. 1 and 2 and designated 10. The flashlight 10 comprises a hollow case 12 having an oval-shaped cross section and is made preferably of a clear, flexible plastic material. A paper sleeve 14 printed with a trademark logo or other similar commercial indicia 16 may be inserted into the case 14.

The flashlight 10 further includes a front cap 18 and a rear cap 20 each comprising an end wall 22 and a connecting peripheral sidewall 24. Each cap sidewall 24 fits closely about an outer side 26 of the case 12. In each cap end wall 22 is an aperture 28. Note that the caps 18,20 are identical.

Fitted inside the case 12 next to the front cap end wall 22 is a middle web section 30 of a U-shaped spring switch 32. This web section 30 is formed with an opening 34. The switch 32 is made of a flexible, conductive material and further includes a pair of spaced apart arms 36 joining respective ends of the web section 30. As formed, the switch arms 36 diverge outwardly at a slight angle, see FIG. 2. To fit into the case 12 these arms 36 must be pressed inward. Once inside the case 12 the switch arms 36 then spring outward so that side edges 37 of the switch arms 36 fit firmly against the paper sleeve 14.

The front cap aperture 28 and the switch web section opening 34 align to receive an outer lens end 38 and a bulb 40. A central enlarged portion 42 of the bulb 40 seats against the switch web section 30. An inner pointed end 44 of the bulb 40 is contained in an opening 46 in a front end 48 of an elongated center post 50.

The center post 50 is formed with concave-shaped sidewall grooves 52 to receive a pair of AAA batteries 54,56. The center post 50 positions the batteries 54,56 in radiused corners 58 of the case 12 with the batteries 54,56 aligning with the switch arm side edges 37. This positioning creates a space 60 between each switch arm 36 and the batteries 54,56, see FIG. 4. Note that maintenance of space 60 is enhanced by the positive positioning of the batteries 54,56 and the outward bias of the switch arms 36.

The first battery 54 has an insulated outer casing 62 and is positioned so that its negatively charged terminal end 64 faces the front cap 18. The bulb 40 is rotated so that a first filament lead wire 66 and a second lead wire 70 which protrude from opposite sides the bulb 40 are each positioned between the batteries 54,56. The first lead wire 66 is connected to the terminal end 64 of the first battery 54 by a solder joint 68. The second lead wire 70 of the bulb 40 in turn is folded forward to fit over the bulb enlarged portion 42 and extend through the switch web section opening 34 next to the bulb lens end 38. The second battery 56 has an uninsulated outer casing 72 and is positioned in an opposing manner so that its negatively charged terminal end 74 faces the rear cap 20.

Extending through the aperture 28 in the rear cap 20 is a looped end 76 of a key ring holder 78. This holder 78 further includes a retaining flange 80 that seats against the rear cap end wall 22. In the rear cap 20 next to the key ring retaining flange 80 is a flat W-shaped pressure plate 82. This pressure plate 82, like the spring switch 32, is made of a flexible, conductive material.

The pressure plate 82 is defined by rearward angled radiused end tabs 84 that join respective inner segments 88 to form a pair of inner apexes 90. Each apex 90 has a dimple 92, see FIG. 2. These dimples 92 seat respectively against a positively charged terminal end 94 of the first battery 54 and the negative terminal end 74 of the second battery 56. The inner segments 88 of the pressure plate 82 connect on an angle to form an outer apex 96. Side edges 98 of each pressure plate inner segment 88 taper inward toward the respective end tabs 84. These side edges 96 and radiused end tabs 84 of the pressure plate 82 interact with the sidewall 24 of the rear cap 20 to self-locate the pressure plate 82 in the rear cap 20.

When the flashlight 10 is assembled, the front and the rear cap 18,20 are placed over ends the case 12, and then are pressed together and held in place by suitable mastic. As seen in FIG. 3, the rear cap end wall 22 engages the radiused end tabs 84 and the key ring flange 80 engages the outer apex 96 of the pressure plate 82. This pressing together of the caps 18,20 compresses the pressure plate 82 slightly to flex the plate 82. This flexing of the pressure plate 82, in turn, produces a continual force to promote uninterrupted electrical contact between the pressure plate dimples 92 and the battery terminal ends 74,94. Additionally, this force is transmitted through the batteries 54,56 to interact a front end of each battery 54,56 with the bulb enlarged portion 42 to hold the bulb lens end 38 tightly in the switch central web section opening 34. With the bulb 40 so held, the bulb second lead wire 70 remains in continual conductive contact with the switch 32.

To operate the flashlight 10 the case 12 is compressed by pressing one's fingers against the case 12, for example. This compression presses at least one of the switch arms 36 into contact with the uninsulated outer casing 72 of the second battery 56. This contact in turn completes an electrical circuit between the bulb 40 and the batteries 54,56 to energize the bulb 40. To deenergize the flashlight 10 the compressive pressure on the case 14 is released to allow the switch arm 36 to disengage from the battery casing 72 and open the circuit.

While an embodiment, uses and advantages of this invention have been shown and described, it should be understood that this invention is only limited by the scope of the claims. Those skilled in the art will understand that various changes may be made without departing from the scope and spirit of the invention, and these changes may result in still further uses and advantages.

What I claim is:

1. A disposable-type flashlight comprising:

a flexible, hollow case, a front and a rear cap affixed to ends of said case, a set of batteries carried in said case, said set including a first battery having an insulated outer casing and a second battery having an uninsulated outer casing with said batteries spaced apart by a center post, a U-shaped spring switch defined by a central web section self-locating in said case adjacent to said front cap and a pair of inward extending arms connecting with said web section, said arms spaced apart and positioned respectively on each side of said batteries and said arms flexing outward away from said batteries to fit firmly against an inner side of said case and form a space between said arms and said batteries respectively, a bulb having a lens end extending through an opening in said switch web section and in said front cap, an enlarged portion butting against said web section, an inner end held by said center post, a first lead wire affixed to a terminal end of said first battery, and a second lead wire fitted in said switch web section opening next to said bulb, and a pressure plate carried in said rear cap with said plate conductively engaging oppositely charged terminal ends of said batteries, wherein compression of said case presses said switch arm against said second battery casing to complete an electrical circuit between said bulb and said batteries and energizes said bulb.

2. A high realiability, reasonably cost, disposable-type flashlight comprising:

a hollow case made of a compressible material, a pair of batteries separated by a center post carried in said case, a spring switch having a central web section carried in said case adjacent to a front cap affixed to an end of said case and a pair of outwardly flexing arms positioned on respective sides of said batteries, a bulb carried by said center post and extending through an opening in said switch web section and an aperture in said front cap with a first lead wire of said bulb attached to one of said batteries and a second lead wire in electrical contact with said switch, and a flexible pressure plate carried in a rear cap affixed to an opposite end of said case, said plate having a W-like shape with inner apexes in electrical contact with oppositely charged terminals ends of batteries respectively, wherein during assembly of said flashlight said pressure plate is flexed to produce a continuous force to enhance said electrical contact between said pressure plate and said batteries and between said bulb lead wire and said switch to increase operational reliability of said flashlight when said case is compressed to place said switch arm in contact with one said battery to complete an electrical circuit and energize said bulb.

3. In a compact, disposable-type flashlight including a flexible, oval-shaped, hollow case, a front and a rear cap closing respective ends of said case, a first and second battery oppositely positioned and spaced apart by a center post to fit snuggly into radiused corners of said case, a bulb having an inner end held by said center post and an outer lens end extending through an aperture in said front cap, and a first and second lead wire extending from said bulb with said first lead wire attached to a charged terminal end of said first battery, an improvement therein comprising:

switch means to allow selective closure of an electrical circuit connecting said batteries to said bulb, said switch means having a front opening holding said bulb and said second lead wire extending therethrough and a pair of arms spaced apart and extending toward said rear cap on each side of said batteries with said arms biased away from said batteries to fit firmly against an inner side of said case and form a space between each said arm and said batteries, and pressure plate means carried in said rear cap, said pressure plate means having a flexible body held in a compressed state between said front and rear cap to create an ongoing force to enhance conductive contact between said pressure plate means and oppositely charged ends of said batteries and like contact between said second lead wire of said bulb and said switch opening, wherein a general compression of said case presses said switch arm in conductive contact with an uninsulated portion of an outer casing of said second battery to energize said bulb in a highly realiable manner.

4. A disposable-type flashlight as defined by claim 3 and further characterized by, said switch means having a U-like shape with said arms connecting with a central web section having said front opening formed herein, said firm fit of said arms with said case defined in part by engagement of side edges of said arms with said case, and said central web section providing self-location of said switch means in said case to promote ready assembly and operational reliability of said flashlight.

5. A disposable-type flashlight as defined by claim 3 and further characterized by, said body of said pressure plate means having a flat W-like shape defined by a pair of spaced radiused end tabs connecting on an angle respectively to a pair of inner segments, each said tab-segment connection forming an inner apex aligning respectively with said battery ends, said inner segments connecting on an angle to form an outer apex, and side edges of said inner segments and said radiused end tabs providing self-location of said pressure plate means in said rear cap.

6. A disposable-type flashlight as defined by claim 5 and further characteristics by, each said inner apex of said pressure plate means formed with a dimple to engage said battery end.

7. A disposable-type flashlight as defined by claim 5 and further characterized by, said compressive state of said pressure plate means resulting from engagement of an end wall of said rear cap with said pressure plate means radiused end tabs and from engagement of a retaining flange of a key ring holder carried in an aperture in said rear cap end wall with said outer apex of said pressure plate means.

* * * * *